US010359021B2

(12) United States Patent
Kawai

(10) Patent No.: US 10,359,021 B2
(45) Date of Patent: Jul. 23, 2019

(54) IGNITION COIL FOR INTERNAL COMBUSTION ENGINE

(71) Applicant: DENSO CORPORATION, Kariya, Aichi-pref. (JP)

(72) Inventor: Kazuhide Kawai, Kariya (JP)

(73) Assignee: DENSO CORPORATION, Kariya (JP)

( * ) Notice: Subject to any disclaimer, the term of this patent is extended or adjusted under 35 U.S.C. 154(b) by 55 days.

(21) Appl. No.: 15/580,295

(22) PCT Filed: Apr. 26, 2016

(86) PCT No.: PCT/JP2016/062981
§ 371 (c)(1),
(2) Date: Dec. 7, 2017

(87) PCT Pub. No.: WO2016/199512
PCT Pub. Date: Dec. 15, 2016

(65) Prior Publication Data

US 2018/0163688 A1 Jun. 14, 2018

(30) Foreign Application Priority Data

Jun. 8, 2015 (JP) ..... 2015-116114

(51) Int. Cl.
*F02P 3/00* (2006.01)
*F02P 13/00* (2006.01)
(Continued)

(52) U.S. Cl.
CPC ..... *F02P 13/00* (2013.01); *F02P 3/04* (2013.01); *F02P 3/0407* (2013.01); *F02P 17/12* (2013.01);
(Continued)

(58) Field of Classification Search
CPC .. F02P 13/00; F02P 3/04; F02P 3/0407; F02P 17/12; H01R 4/489; H01R 13/03; H01F 27/306; H01F 27/022; H01F 38/12
(Continued)

(56) References Cited

U.S. PATENT DOCUMENTS 5,218,936 A * 6/1993 Pritz ..... F02P 3/02 123/143 C
5,602,714 A * 2/1997 Shimizu ..... H01F 38/12 123/647
(Continued)

FOREIGN PATENT DOCUMENTS

JP 2009-272181 11/2009
JP 2011-071246 4/2011
(Continued)

OTHER PUBLICATIONS

International Search Report issued in PCT/JP2016/062981 dated Jul. 26, 2016 (2 pages).

*Primary Examiner* — Hai H Huynh
(74) *Attorney, Agent, or Firm* — Nixon & Vanderhye PC

(57) ABSTRACT

An ignition coil has a primary coil and a secondary coil, a coil terminal, a connector terminal and a connector part. The connector part has a coil-side lead wire and a connector-side lead wire. The coil terminal has a coil-side fitting groove part into which the coil-side lead wire is fitted. An internal edge surface of the coil-side fitting groove part is formed internally to have a protruded curved surface. The connector terminal has a connector-side fitting groove part into which the connector-side lead wire is fitted. An internal edge surface of the connector-side fitting groove part is formed internally to have a protruded curved surface. The coil-side lead wire is inserted into the coil-side fitting groove part in a direction perpendicular to a longitudinal direction thereof.
(Continued)

The connector-side lead wire is fitted into the connector-side fitting groove part in a direction perpendicular to a longitudinal direction thereof.

12 Claims, 10 Drawing Sheets

(51) Int. Cl.

| | |
|---|---|
| ***H01F 38/12*** | (2006.01) |
| ***F02P 3/04*** | (2006.01) |
| ***F02P 17/12*** | (2006.01) |
| ***H01F 27/02*** | (2006.01) |
| ***H01F 27/30*** | (2006.01) |
| ***H01R 4/48*** | (2006.01) |
| *H01R 13/03* | (2006.01) |

(52) U.S. Cl.
CPC ..... *H01F 27/022* (2013.01); *H01F 27/306* (2013.01); *H01F 38/12* (2013.01); *H01R 4/489* (2013.01); *H01R 13/03* (2013.01)

(58) Field of Classification Search
USPC ..... 123/605, 635, 647
See application file for complete search history.

(56) References Cited

U.S. PATENT DOCUMENTS

| | | | | |
|---|---|---|---|---|
| 2004/0069288 | A1* | 4/2004 | Shimada | F02P 3/02 123/635 |
| 2009/0260608 | A1* | 10/2009 | Fujiyama | H01F 3/00 123/634 |

FOREIGN PATENT DOCUMENTS

| | | |
|---|---|---|
| JP | 2012-174828 | 9/2012 |
| JP | 2012-235029 | 11/2012 |

* cited by examiner

IGNITION COIL FOR INTERNAL COMBUSTION ENGINE

This application is the U.S. national phase of International Application No. PCT/JP2016/062981 filed 26 Apr. 2016, which designated the U.S. and claims priority to JP Patent Application No. 2015-116114 filed 8 Jun. 2015, the entire contents of each of which are hereby incorporated by reference.

TECHNICAL FIELD

The present invention relates to ignition coils to be used in internal combustion engines.

BACKGROUND ART

There are ignition coils to be used in internal combustion engines. Such an ignition coil has a primary coil, a secondary coil and power-source connector terminals to be connected to a power source. Patent document 1 discloses a structure of an ignition coil, in which a low voltage side of a secondary coil is connected to a power-source connector terminal connected to a power source through a diode. In the structure of the ignition coil disclosed in Patent document 1, a lead wire is connected to the diode and pressed and inserted into a slit which is formed at an end part of the power-source connector terminal. There is another ignition coil having a structure in which the low voltage side of the secondary coil is connected to the power-source connector terminal through a conductor wire instead of using the diode.

CITATION LIST

Patent Literature

[Patent document 1] Japanese patent laid open publication No. JP 2012-174828.

SUMMARY OF INVENTION

Technical Problem

However, such a conventional ignition coil disclosed in Patent document 1 has a following drawback. That is, it is possible to easily connect the connector part such as the diode with the power-source connector terminal because the connector part is pressed and inserted into the slit formed in the power-source connector terminal. However, it becomes difficult to easily connect the connector part with the secondary coil because the connector part is not pressed and inserted into the secondary coil.

There is a possible problem in which the edge of the power-source connector terminal presses to and cuts the lead wire when the lead wire is pressed and inserted into the slit formed in the power-source connector terminal. For example, edges are formed in an area facing the slit when a metal plate is punch-pressed to form the power-source connector terminal, and the edges presses to and cuts the lead wire. In this case, the lead wire is shaven by the edges, and conductive foreign matter is generated, and the generated conductive foreign matter is scattered in the inside of a casing of the ignition coil. When the conductive foreign matter is mixed with mold resin to seal the casing of the ignition coil, this reduces the insulation function of the mold resin.

Further, when the edge of the power-source connector terminal presses to and cuts the lead wire, a notch is formed in the lead wire. In this case, the notch is exposed to thermal stress generated by reciprocation of heating and cooling, and this reduces durability of the lead wire in the ignition coil.

The present invention has been made in consideration of the foregoing circumstances, and it is an object of the present invention to provide an ignition coil having superior insulation and durability to be used for an internal combustion engine. It is possible to easily assemble connector parts with the ignition coil.

Solution to Problem

In accordance with an aspect of the present invention, there is provided an ignition coil for an internal combustion engine. The ignition coil has a primary coil, a secondary coil, a coil terminal, a connector terminal and a connector part. The primary coil and the secondary coil are magnetically connected with each other. The coil terminal is connected to a low voltage side of the secondary coil. The connector terminal is electrically connected to an external device. The connector part is connected to and suspended by both the coil terminal and the connector terminal. In the ignition coil, the connector part has a coil-side lead wire and a connector-side lead wire. The coil-side lead wire is made of wire member connected to the coil terminal. The connector-side lead wire is made of wire member connected to the connector terminal. The coil terminal has a coil-side fitting groove part into which the coil-side lead wire is pressed and inserted. An internal edge surface of the coil-side fitting groove part is formed internally to have a protruded curved surface. The connector terminal has a connector-side fitting groove part into which the connector-side lead wire is pressed and inserted. An internal edge surface of the connector-side fitting groove part is formed internally to have a protruded curved surface. The coil-side lead wire is pressed and inserted into the coil-side fitting groove part in a direction which is perpendicular to a longitudinal direction of the coil-side lead wire. The connector-side lead wire is pressed and inserted into the connector-side fitting groove part in a direction which is perpendicular to a longitudinal direction of the connector-side lead wire. In the ignition coil previously described, the coil terminal is made of wire member, and supported by a terminal holder formed in a bobbin in which the secondary coil is wounded, and the terminal holder comprises a deformation limitation part which limits expansion of the coil-side fitting groove part.

In accordance with another aspect of the present invention, there is provided an ignition coil for an internal combustion engine. The ignition coil has a primary coil and a secondary coil magnetically connected with each other, a coil terminal connected to a low voltage side of the secondary coil, a connector terminal electrically connected to an external device, and a connector part connected to and suspended by both the coil terminal and the connector terminal. In the ignition coil previously described the connector part comprises a coil-side lead wire made of wire member connected to the coil terminal, and a connector-side lead wire made of wire member connected to the connector terminal. The coil terminal has a coil-side fitting groove part into which the coil-side lead wire is pressed and inserted, and an internal edge surface of the coil-side fitting groove part is formed internally to have a protruded curved surface. The connector terminal has a connector-side fitting groove part into which the connector-side lead wire is pressed and inserted, and an internal edge surface of the connector-side fitting groove part is formed internally to have a protruded curved surface. The coil-side lead wire is pressed and inserted into, i.e. is fitted with the coil-side fitting groove part in a direction which is perpendicular to a longitudinal direction of the coil-side lead wire. The connector-side lead wire is pressed and inserted into the connector-side fitting groove part in a direction which is perpendicular to a longitudinal direction of the connector-side lead wire. Further, a depth direction of the coil-side fitting groove part is equal to a depth direction of the connector-side fitting groove part.

In accordance with another aspect of the present invention, there is provided an ignition coil for an internal combustion engine. The ignition coil has a primary coil and a secondary coil magnetically connected with each other, a coil terminal connected to a low voltage side of the secondary coil, a connector terminal made of wire member and electrically connected to an external device, and a connector part connected to and suspended by both the coil terminal and the connector terminal. In the ignition coil, the connector part has a coil-side lead wire made of wire member connected to the coil terminal, and a connector-side lead wire made of wire member connected to the connector terminal. The coil terminal has a coil-side fitting groove part into which the coil-side lead wire is pressed and inserted. An internal edge surface of the coil-side fitting groove part is formed internally to have a protruded curved surface. The connector terminal has a connector-side fitting groove part into which the connector-side lead wire is pressed and inserted. An internal edge surface of the connector-side fitting groove part is formed internally to have a protruded curved surface. The coil-side lead wire is pressed and inserted into i.e. is fitted with the coil-side fitting groove part in a direction which is perpendicular to a longitudinal direction of the coil-side lead wire. The connector-side lead wire is pressed and inserted into the connector-side fitting groove part in a direction which is perpendicular to a longitudinal direction of the connector-side lead wire.

Advantageous Effects of Invention

In the structure of the ignition coil for in an internal combustion engine, the coil-side lead wire of the connector part is pressed and inserted into the coil-side fitting groove part of the coil terminal, and the connector-side lead wire of the connector terminal is pressed and inserted into the connector-side fitting groove part of the connector terminal. This structure allows the connector part to be easily assembled with the coil terminal and the connector terminal. Hereinafter, the coil terminal and the connector terminal will be also referred to as the "terminals" simply. Similarly, the coil-side fitting groove part and the connector-side fitting groove part will be also referred as the "fitting groove parts" simply. Further, the coil-side lead wire and the connector-side lead wire will be also referred as the "lead wires" simply.

The internal edge surface of each of the coil-side fitting groove part and the connector-side fitting groove part is formed to have protruded curved surface internally. This structure makes it possible to suppress each lead wire from being cut when the coil-side lead wire and the connector-side lead wire are pressed and inserted into the coil-side fitting groove part and the connector-side fitting groove part, respectively. That is, the coil-side lead wire and the connector-side lead wire are in contact with the coil terminal and the connector terminal at the protruded curved surface, respectively when those lead wires are fitted into the corresponding fitting groove parts. This makes it possible to prevent the lead wires from being cut, and to prevent conductive foreign matter from being generated and scattered in the inside of the ignition coil. As a result, this prevents deterioration of the electrical insulation of the ignition coil. In addition to this feature, this structure makes it possible to prevent notches from being generated in the coil-side lead wire and the connector-side lead wire, and to increase the lifetime of the ignition coil.

As previously described, the present invention provides an ignition coil, to be used in various internal combustion engines, having superior electrical insulation properties and superior durability, and a superior assembling structure into which a connector part can be easily assembled.

DESCRIPTION OF EMBODIMENTS

First Exemplary Embodiment

A description will be given of the ignition coil 1 for an internal combustion engine according to the first exemplary embodiment with reference to FIG. 1 to FIG. 7.

Figure 1:
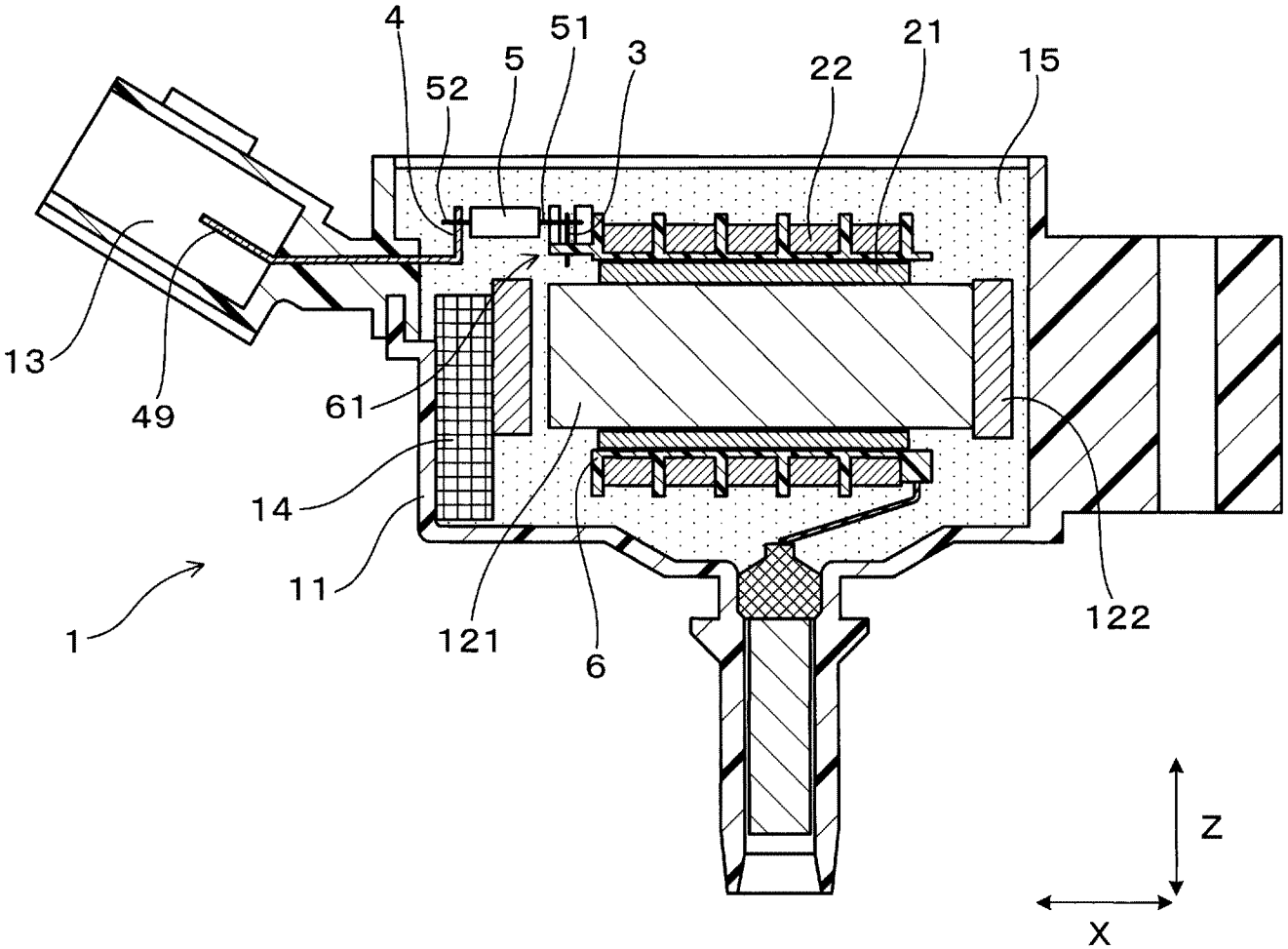
FIG. 1 is a view showing a cross section of an ignition coil for an internal combustion engine according to a first exemplary embodiment.

As shown in FIG. 1, the ignition coil 1 according to the first exemplary embodiment has a primary coil 21 and a secondary coil 22 which are magnetically connected with each other, a coil terminal 3 connected to a low voltage side of the secondary coil 22, a connector terminal 4 which is electrically connected to an external device, a connector part 5 which is connected to and suspended by both the coil terminal 3 and the connector terminal 4.

Figure 2:
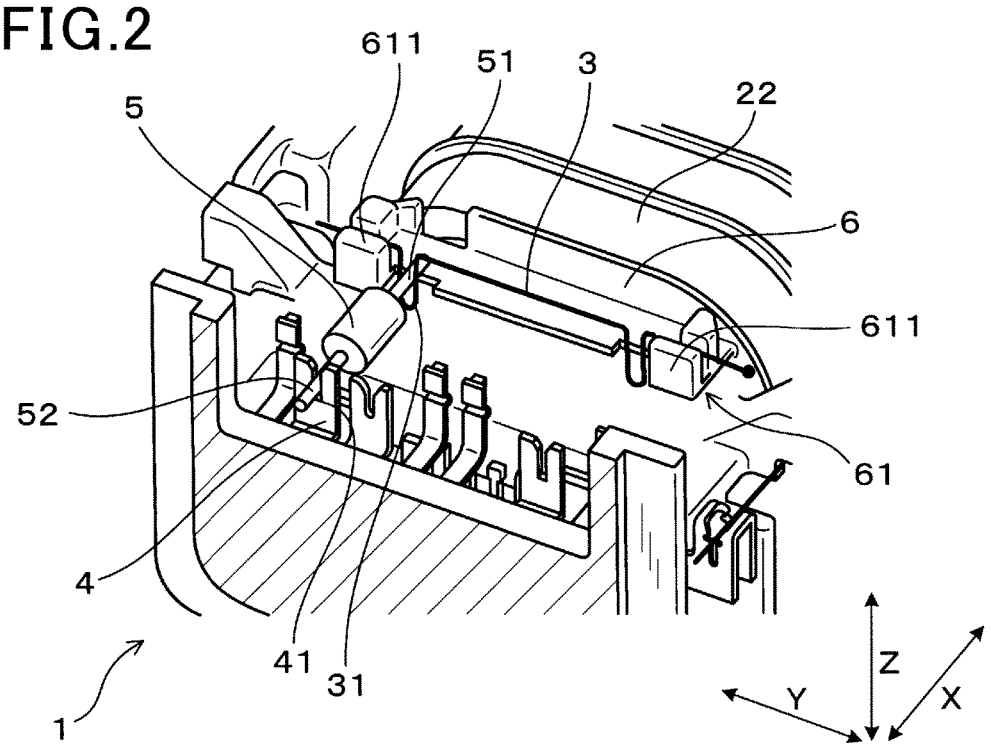
FIG. 2 is a perspective view showing a part of the ignition coil for an internal combustion engine according to the first exemplary embodiment.
Figure 3:
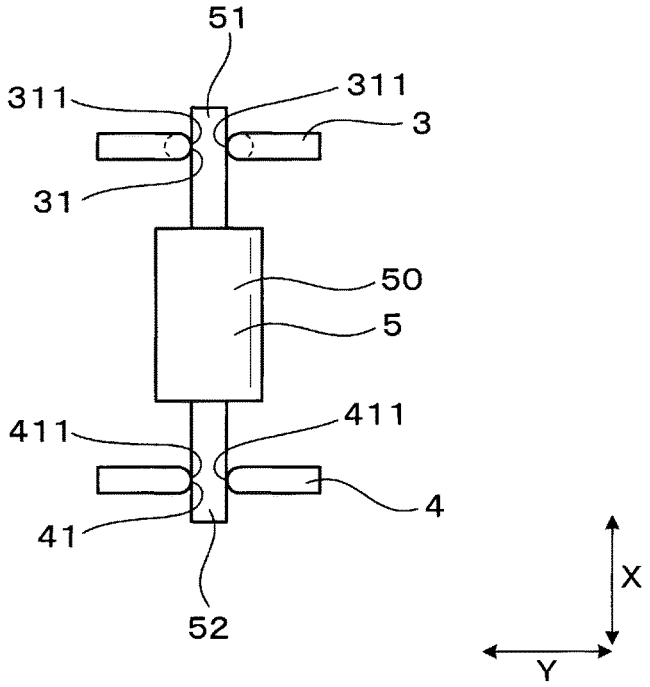
FIG. 3 is a plan view showing a connector part connected to a coil terminal and a connector terminal in the ignition coil for an internal combustion engine according to the first exemplary embodiment.
Figure 4:
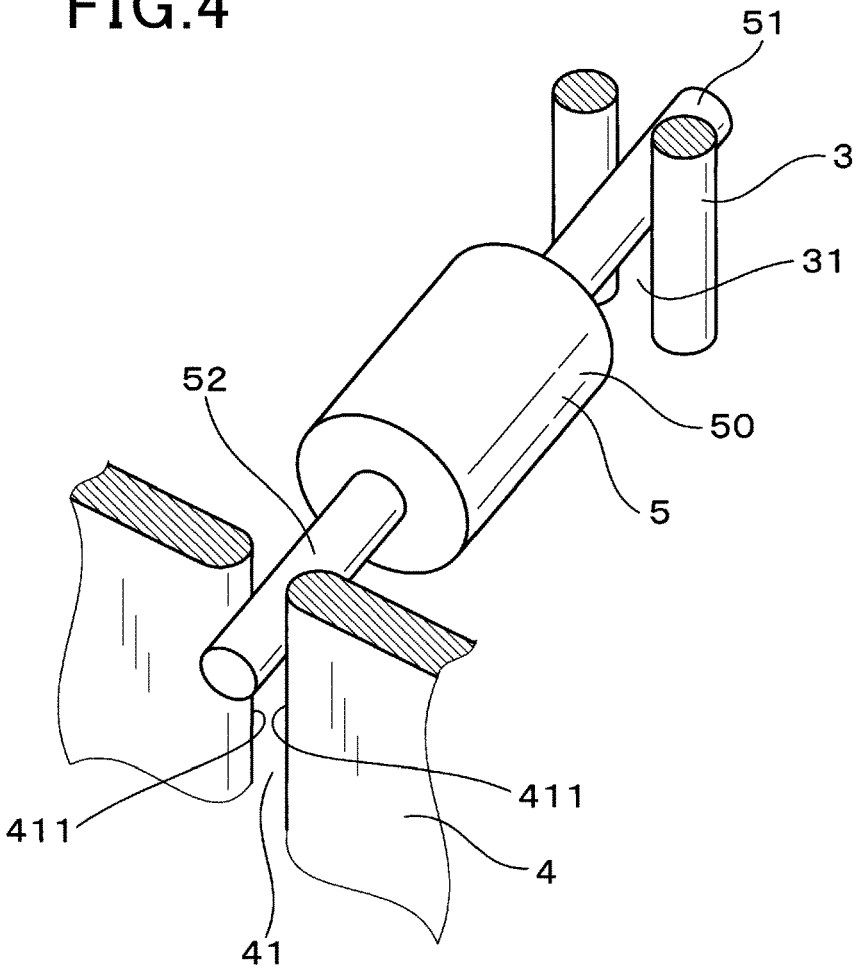
FIG. 4 is a perspective view showing the connector part connected to the coil terminal and the connector terminal in the ignition coil for an internal combustion engine according to the first exemplary embodiment.
Figure 5:
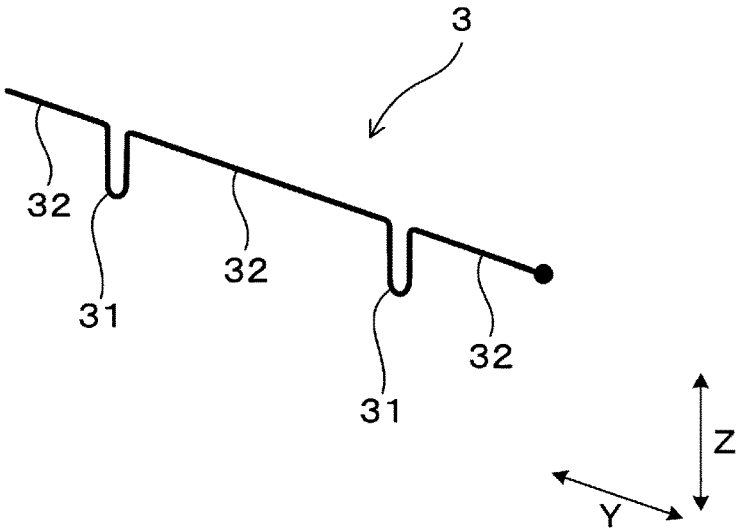
FIG. 5 is a perspective view showing the coil terminal in the ignition coil for an internal combustion engine according to the first exemplary embodiment.

As shown in FIG. 2 to FIG. 4, the connector part 5 has a coil-side lead wire 51 made of wire member connected to the coil terminal 3 and a connector-side lead wire 52 made of wire member connected to the connector terminal 4. As shown in FIG. 3 to FIG. 5, the coil terminal 3 has a coil-side fitting groove part 31 into which the coil-side lead wire 51 is pressed and inserted. An internal edge surface 311 of the coil-side fitting groove part 31 is formed internally to have a protruded curved surface.

Figure 6:
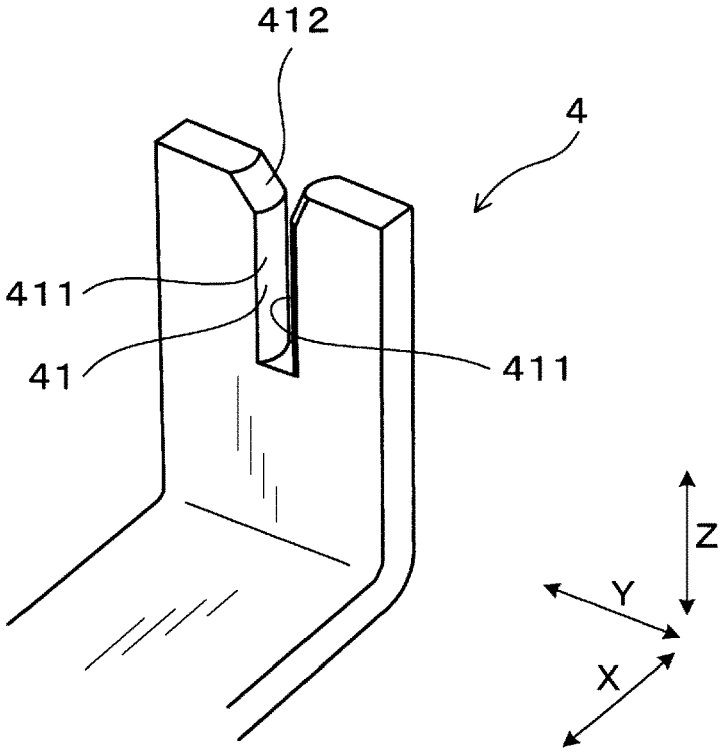
FIG. 6 is a perspective view showing the connector terminal in the ignition coil for an internal combustion engine according to the first exemplary embodiment.

As shown in FIG. 3, FIG. 4 and FIG. 6, the connector terminal 4 has a connector-side fitting groove part 41 into which the connector-side lead wire 52 is pressed and inserted. An internal edge surface 411 of the connector-side fitting groove part 41 is formed internally to have a protruded curved surface. As shown in FIG. 2 and FIG. 4, the coil-side lead wire 51 is pressed and inserted into the coil-side fitting groove part 31 in a direction which is perpendicular to a longitudinal direction of the coil-side lead wire 51. The connector-side lead wire 52 is pressed and inserted into the connector-side fitting groove part 41 in a direction which is perpendicular to a longitudinal direction of the connector-side lead wire 52.

The ignition coil 1 is connected to a spark plug (not shown) which is installed into an internal combustion engine such as vehicles, co-generation systems, etc. The ignition coil 1 is used as a high power voltage to the spark plug.

As shown in FIG. 1, the ignition coil 1 has a casing 11 which accommodates the primary coil 21 and the secondary coil, etc.

The casing 11 has an opening surface formed at one side of the casing 11 when viewed in a direction (hereinafter, also referred to as the "vertical direction Z") which is perpendicular to an axial direction (hereinafter, also referred to as the "axial direction X") of the primary coil 21 and the secondary coil 22. Hereinafter, the opening surface side of the casing 11 is also referred to as the "upper side" of the casing 11, and the opposing side of the upper side of the casing 11 is also referred to as the "bottom side" of the casing 11. However, this structure does not limit the upper side and the bottom side of the casing 11.

A central core 121 and an outer circumference core 122 are arranged at the inner circumference side and the outer circumference side of the primary coil 21 and the secondary coil 22, respectively. The secondary coil 22 is wound around a bobbin 6 made of resin at the outer circumference side of the primary coil 21.

An outer connector 13 is arranged in the casing 11. The outer connector 13 is connected to a battery as an outside device. An outside end part 49 of the connector terminal 4 is arranged in the outer connector 13. An ignitor 14 is arranged in the casing 11 so as to switch turning ON/OFF of the power supply to the primary coil 21.

The casing 11 accommodates the primary coil 21 and the secondary coil 22, the central core 121, the outer circumference core 122, the ignitor 14, the coil terminal 3, the connector terminal 4 and the connector part 5. The casing 11 is sealed with the mold resin 15. For example, the mold resin is made of epoxy resin.

As shown in FIG. 4 and FIG. 5, the coil terminal 3 is made of wire member. That is, the wire member is bent to produce the coil terminal 3 having the coil-side fitting groove part 31. The wire member forming the coil terminal 3 is a conductive wire member having a cross section of a circular shape, which is perpendicular to the longitudinal direction of the wire member. For example, the wire member is made of metal such as phosphor copper or phosphor bronze material as spring material. The wire member is shaped by a drawing process. At least a part of the wire member, which is in contact with the coil-side lead wire 51, is not covered with an insulation film, etc. and is exposed to outside. That is, metal such as phosphor copper is exposed at this part of the wire member.

A low voltage-side terminal of the winding of the secondary coil 22 is connected to the coil terminal 3. That is, the winding of the secondary coil 22 has a high voltage-side terminal connected to a spark plug and the low voltage-side terminal of the winding of the secondary coil connected to the terminal coil 3.

As shown in FIG. 5, the coil terminal 3 has a lateral-direction part 32 and the coil-side fitting groove part 31. The lateral-direction part 32 of the coil terminal 3 extends toward the lateral direction Y which is perpendicular to both the axial direction X and the vertical direction Z. The coil-side fitting groove part 31 is formed vertically toward the bottom from a part of the coil terminal 3 which extends toward the lateral direction. The coil-side fitting groove part 31 substantially has a U-character shape, the upper side of which has opening, as shown in FIG. 5. That is, the coil terminal 3 has the two coil-side fitting groove parts 31. As shown in FIG. 2, the coil-side lead wire 51 is pressed and inserted into the corresponding coil-side fitting groove part 31.

The coil terminal 3 is supported by a terminal holder 61 formed in the bobbin 6 on which the secondary coil 22 is wound. The terminal holder 61 is arranged at the end part in the axial direction X, which is close to the outer connector 13 of the bobbin 6. The terminal holder 61 has a pair of claw parts 611. The coil terminal 3 is supported by the terminal holder 61 so that the both ends in the lateral direction Y of the coil terminal 3 are fitted with the pair of the claw parts 611, respectively.

The connector terminal 4 is made of a plate member. Each connector terminal 4 has the connector-side fitting groove part 41 produced by punch-pressing and bending a metal plate.

In the first exemplary embodiment, as shown in FIG. 6, the connector-side fitting groove part 41 is formed by a slit which is formed at a part of the metal plate. The internal edge surface 411 of the connector-side fitting groove part 41 is formed internally to have a protruded curved surface. That is, the internal edge surface 411 has a cross section of a curved surface, which is perpendicular to the depth direction of the connector-side fitting groove part 41.

It is possible to form the protruded curved surface of the internal edge surface 411 by press-pushing the corner edges of the metal plate, facing the slit, at both sides of the metal plate in the thickness direction of the metal plate after punching-press. The edge of the opening part of the connector-side fitting groove part 41 has an expansion part 412 which gradually expands toward the opening part (that is, toward the upper side of the connector-side fitting groove part 41.

As shown in FIG. 2, the coil-side fitting groove part 31 and the connector-side fitting groove part 41 have the same depth direction. In the first exemplary embodiment, the depth direction of each of the coil-side fitting groove part 31 and the connector-side fitting groove part 41 is the vertical direction Z.

The ignition coil 1 for an internal combustion engine according to the first exemplary embodiment uses a diode as the connector part 5. As shown in FIG. 3 and FIG. 4, the connector part 5 is composed of a diode element 50, the coil-side lead wire 51 and the connector-side lead wire 52. The coil-side lead wire 51 and the connector-side lead wire 52 are formed at and protruded from both edge sides of the diode element 50, respectively. The wire member forming the coil-side lead wire 51 and the connector-side lead wire 52 has a conductive member having a cross section of a circular shape which is perpendicular to the longitudinal direction of the conductive member. For example, the lead wire is made of phosphor copper or phosphor bronze material. The wire member is produced by punch-pressing. At least a part of the wire member, which is in contact with the coil terminal 4 or the connector terminal 4, is not covered with an insulation film, etc. and is exposed to outside. That is, metal such as phosphor copper is exposed at this part of the wire member.

Figure 7:
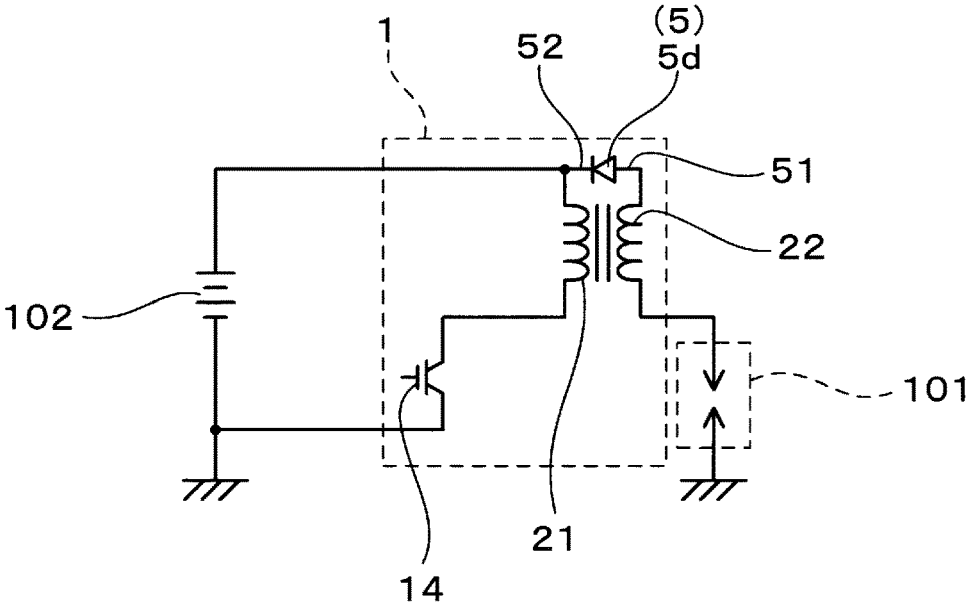
FIG. 7 is a view showing a circuit diagram of an ignition device using the ignition coil for an internal combustion engine according to the first exemplary embodiment.

In the circuit diagram shown in FIG. 7, the ignition coil 1 forms a part of the ignition device to be sued in an internal combustion engine. One end of the primary coil 21 in the ignition coil 1 is connected to a positive electrode of the battery 102. The other end of the primary coil 21 is connected to a negative terminal of the battery 102 through the ignitor 14. It is possible to form the ignitor 14 by using an IGBT (an insulated gate bipolar transistor) or a MOS FET (a metal oxide semiconductor field effect transistor).

A high-voltage side of the secondary coil 22 is connected to the spark plug 101, and a low-voltage side of the secondary coil 22 is connected to the positive electrode of the battery 102 through the diode **5*d* (i.e. the connector part 5**).

The diode **5*d* is electrically connected to the positive electrode of the battery 102 through the connector terminal 4. The diode 5*d* is electrically connected to the low-voltage side of the secondary coil 22 through the coil terminal 3. An anode of the diode 5*d* is connected to the coil terminal 3, and a cathode of the diode 5*d* is connected to the connector terminal 4. That is, the anode of the diode 5*d* is the coil-side lead wire 51 and the cathode of the diode 5*d* is the connector-side lead wire 52**.

In the ignition coil 1 having the structure previously described according to the first exemplary embodiment, the switching operation of the ignitor 14 switches turning ON/OFF of the power supply to the primary coil 21. When the ON state of the power supply to the primary coil 21 is switched to the OFF state, a second voltage induced in the secondary coil 22 is supplied to the spark plug 101. When the induced second voltage is generated in the secondary coil 22, a current flows from the high voltage side of the spark plug 101 to the low voltage side of the diode **5*d***.

The diode **5*d* prevents generation of a reverse current which flows in opposite direction of this current. That is, the diode 5*d* prevents the induced current from being generated in the secondary coil 22 when the power supply to the primary coil 21 is switched from the OFF state to the ON state. In the structure of the ignition coil 1 according to the first exemplary embodiment, the cathode of the diode 5*d* is connected to the positive electrode of the battery. However, it is acceptable to connect the cathode of the diode 5*d*** with the negative electrode of the battery. This connection structure can also have the same effects.

Next, a description will be given of the ignition coil 1 according to the first exemplary embodiment.

The coil-side lead wire 51 of the connector part 5 is pressed and inserted into the coil-side fitting groove part 31 of the coil terminal 3. The connector-side lead wire 52 of the connector part 5 is pressed and inserted into the connector-side fitting groove part 41. This structure makes it possible to easily assemble the connector part 5 with the coil terminal 3 and the connector terminal 4 together.

Each of the internal edge surface 311 of the coil-side fitting groove part 31 and the internal edge surface 411 of the connector-side fitting groove part is 41 is formed internally to have a protruded curved surface. This structure makes it possible to prevent the coil-side lead wire 51 and the connector-side lead wire 52 from being cut when the coil-side lead wire 51 and the connector-side lead wire 52 are pressed and inserted into the coil-side fitting groove part 31 and the connector-side fitting groove part 41, respectively.

That is, when the coil-side lead wire 51 and the connector-side lead wire 52 are pressed and inserted into the coil-side fitting groove part 31 and the connector-side fitting groove part 41, the coil-side lead wire 51, the connector-side lead wire 52, the coil terminal 3 and the connector terminal 4 are in contact with each other at the curved-surface thereof. As a result, this structure makes it possible to prevent generation of conductive foreign matter, and to prevent conductive foreign matter from being scattered in the inside of the ignition coil 1. Further, this structure makes it possible to prevent reduction of the insulation properties of the ignition coil 1, to prevent generation of notch in the coil-side lead wire 51 and the connector-side lead wire 52, and to increase durability of the ignition coil 1.

The wire member is bent to produce the coil terminal 3. The side surface of the wire member has a smoothly curved shape. In particular, the coil terminal 3 and the coil-side lead wire 51 are made of wire member, a cross section of which has a circular shape. This structure makes it possible to prevent the coil-side lead wire 51 from being cut when the coil-side lead wire 51 of the connector part 5 is pressed and inserted into the coil-side fitting groove part 31 of the coil terminal 3. That is, because the contact between the coil-side lead wire 51 and the coil terminal 3 is the contact between the wire members having a cross section of a circular shape during the press-inserting process previously described, this structure makes it possible to prevent the coil terminal 3 and the coil-side lead wire 51 from being cut. Further, because the coil terminal 3 is made of wire member, it is possible to increase material yield.

Because the coil terminal 3 is supported by the terminal holder 61 which is formed in the bobbin 6, this structure makes it possible to easily connect the coil terminal 3 with the secondary coil 22. Further, because the connector terminal 4 is made of a plate member, this makes it possible to easily produce the connector terminal 4.

Still further, the depth direction of the coil-side fitting groove part 31 is equal to the depth direction of the connector-side fitting groove part 41. For this reason, the coil-side lead wire 51 and the connector-side lead wire 52 are pressed and inserted into the coil-side fitting groove part 31 and the connector-side fitting groove part 41, respectively in the same direction. This makes it possible to provide easy assembling process of the connector part 5 with the ignition coil 1. It is also acceptable for depth direction of the coil-side fitting groove part 31 to be approximately equal to the depth direction of the connector-side fitting groove part 41. It is possible to vary those depth directions within a range so long as the same effects can be obtained. It is also acceptable for the depth direction of the coil-side fitting groove part 31 and the depth direction of the connector-side fitting groove part 41 to slant with each other.

As previously described, according to the structure of the ignition coil 1 for an internal combustion engine of the first exemplary embodiment, it is possible to easily assemble the connector part with the ignition coil 1, and for the ignition coil 1 to have superior insulation properties and durability.

Second Exemplary Embodiment

A description will be given of the ignition coil 1 for an internal combustion engine according to a second exemplary embodiment with reference to FIG. 8 and FIG. 9.

Figure 8:
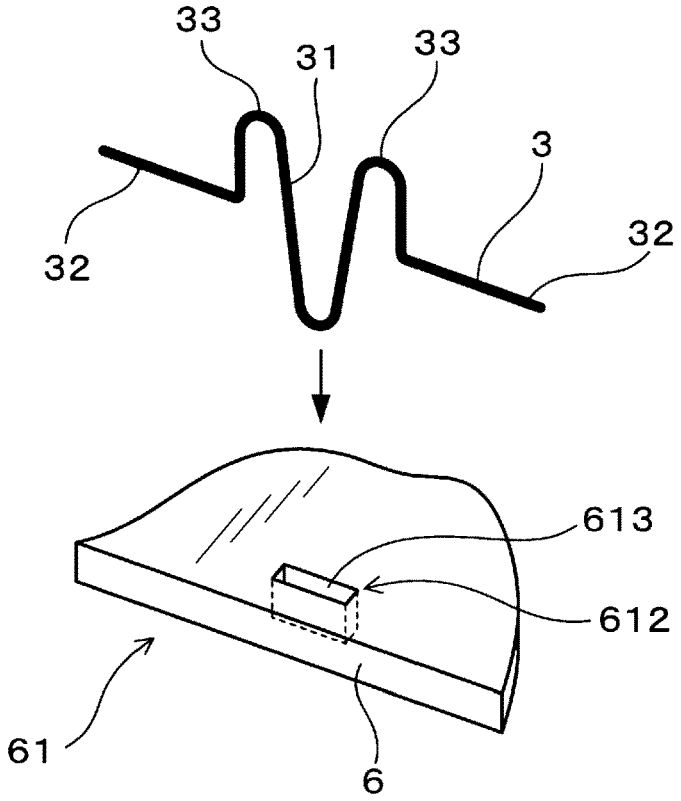
FIG. 8 is a perspective view showing a terminal holder having a deformation limitation part and the coil terminal in the ignition coil for an internal combustion engine according to a second exemplary embodiment.
Figure 9:
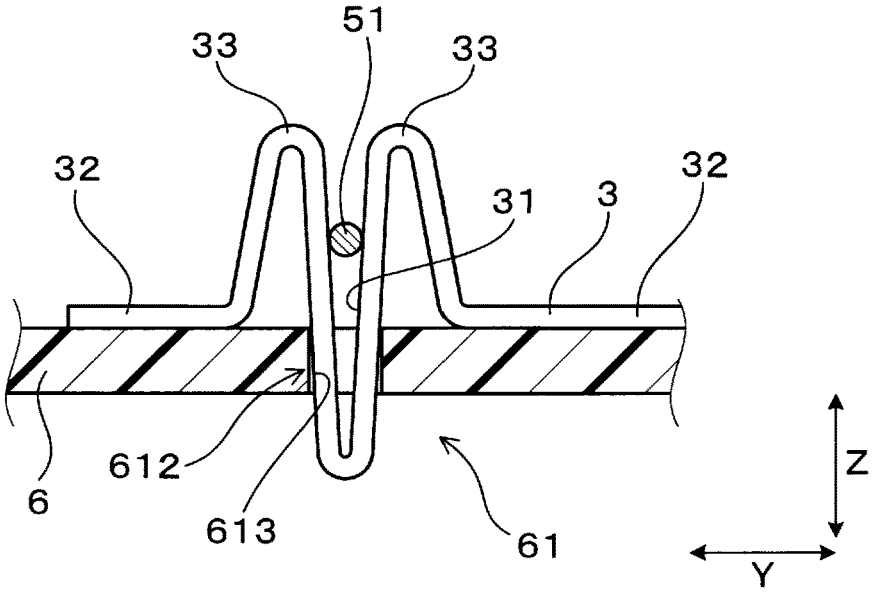
FIG. 9 is a view explaining a cross section of the deformation limitation part in the ignition coil for an internal combustion engine according to the second exemplary embodiment.

As shown in FIG. 8 and FIG. 9, the ignition coil 1 for an internal combustion engine of the second exemplary embodiment has the structure in which the terminal holder 61 has a deformation limitation part 612 which prevents expansion of the coil-side fitting groove part 31. The deformation limitation part 612 is formed by a penetration hole 613 formed at a part of the bobbin 6. The penetration hole 613 penetrates in the vertical direction Z, and a part of the coil terminal 3 is inserted into the penetration hole 613. As shown in FIG. 9, a part of the coil-side fitting groove part 31 of the coil terminal 3 is inserted into the penetration hole 613. A part of the coil-side fitting groove part 31 is arranged at the upper side of the penetration hole 613. The coil-side lead wire 51 is inserted into the coil-side fitting groove part 31 at the upper side of the penetration hole 613.

As shown in FIG. 8 and FIG. 9, the coil terminal 3 has an upper-side projection part 33 which protrudes toward the upper side rather than the lateral-direction part 32. The upper-side projection part 33 is formed by bending the coil terminal 3 toward the upper side and bending it toward the bottom direction. As shown in FIG. 9, it is possible to arrange the part of the coil-side fitting groove part 31 surely has an adequate depth and is arranged at an upper side rather than the penetration hole 613 after a part of the coil terminal 3 has inserted into the penetration hole 613. Other parts and components of the ignition coil 1 for an internal combustion engine of the second exemplary embodiment are the same as those of the ignition coil 1 for an internal combustion engine of the first exemplary embodiment. The same reference numbers and characters between the first exemplary embodiment and the second exemplary embodiment indicate the same parts and components in the ignition coil 1. The explanation of the same parts and components is omitted here for brevity.

In the ignition coil 1 for an internal combustion engine of the second exemplary embodiment, the deformation limitation part 612 prevents the coil-side fitting groove part 31 from further expanding in the lateral direction Y. This structure makes it possible to maintain the supporting state of the coil-side lead wire 51 in the coil-side fitting groove part 31. Accordingly, the second exemplary embodiment makes it possible to provide a superior structure of the ignition coil 1 and stably assemble the connector part 5 with the ignition coil 1. The ignition coil 1 for an internal combustion engine of the second exemplary embodiment has the same action and effects of the ignition coil 1 for an internal combustion engine of the first exemplary embodiment.

Third Exemplary Embodiment

Figure 10:
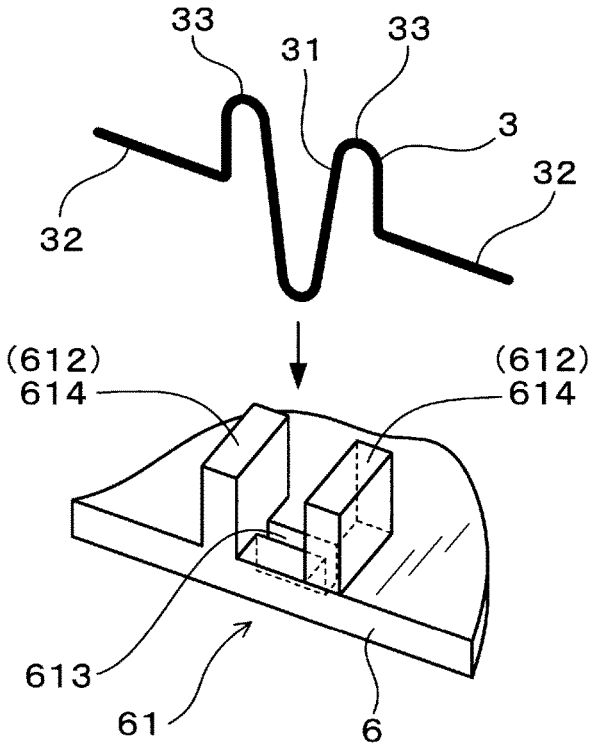
FIG. 10 is a perspective view showing the terminal holder having the deformation limitation part and the coil terminal in the ignition coil for an internal combustion engine according to a third exemplary embodiment.

A description will be given of the ignition coil 1 for an internal combustion engine according to a third exemplary embodiment with reference to FIG. 10. As shown in FIG. 10, the ignition coil 1 for an internal combustion engine of the third exemplary embodiment has a pair of fitting protruded parts 614. The pair of fitting protruded parts 614 are formed close to the penetration hole 613 to protrude toward the upper side. The pair of fitting protruded parts 614 become the deformation limitation part 612 which limits expansion of the coil-side fitting groove part 31. That is, the pair of upper-side projection parts 33 in the coil terminal 3 are fitted with the pair of fitting protruded parts 614, respectively. Accordingly, the pair of fitting protruded parts 614 fix, in the lateral direction Y, both the sides of the coil-side fitting groove part 31 of the coil terminal 3, this prevents the coil-side fitting groove part 31 from expanding.

Other parts and components of the ignition coil 1 for an internal combustion engine of the third exemplary embodiment are the same as those of the ignition coil 1 for an internal combustion engine of the second exemplary embodiment. The same reference numbers and characters between the third exemplary embodiment and the second exemplary embodiment indicate the same parts and components in the ignition coil 1. The explanation of the same parts and components is omitted here for brevity. The ignition coil 1 for an internal combustion engine of the third exemplary embodiment has the same action and effects of the ignition coil 1 for an internal combustion engine of the second exemplary embodiment.

Fourth Exemplary Embodiment

Figure 11:
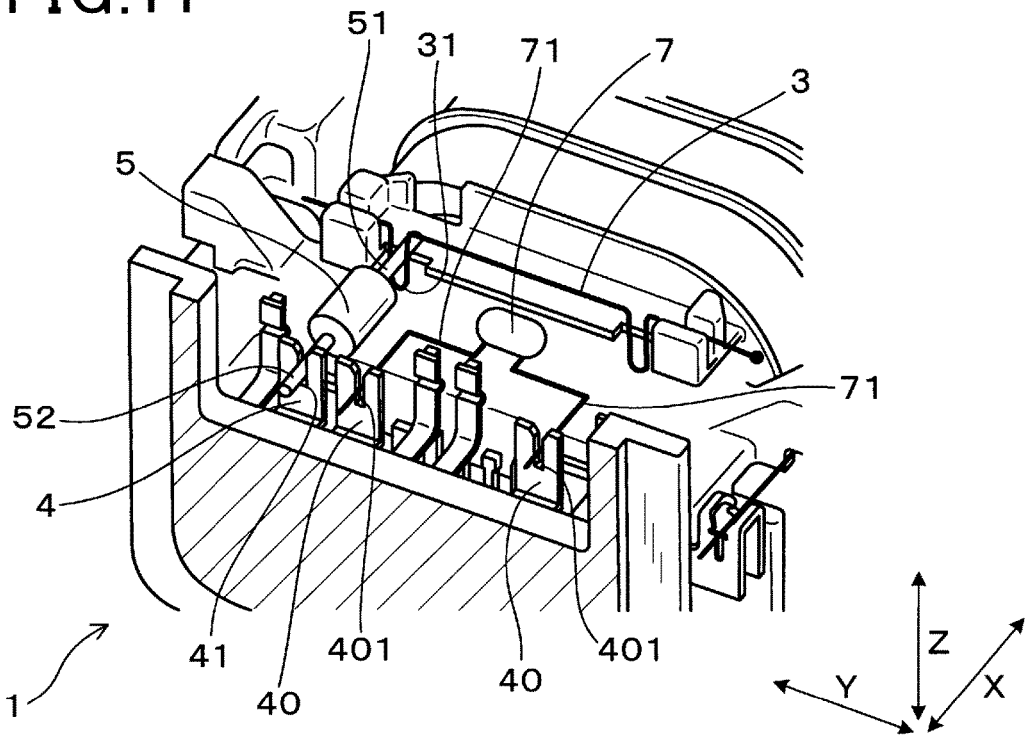
FIG. 11 is a perspective view showing a part of the ignition coil for an internal combustion engine according to a fourth exemplary embodiment.

A description will be given of the ignition coil 1 for an internal combustion engine according to a fourth exemplary embodiment with reference to FIG. 11. As shown in FIG. 11, the ignition coil 1 for an internal combustion engine of the fourth exemplary embodiment has a plurality of the connector terminals 4, 40 which are electrically insulated from each other. An electronic component 7 is supported and connected to the two connector terminals 40 in the plurality of the connector terminals 40.

The electronic component 7 has a pair of lead wires 71 made of wire member connected to the connector terminal 4. The pair of connector terminals 40, connected to the pair of lead wires 71, have a pair of fitting groove parts 401. The pair of lead wires 71 are pressed and fitted into the pair of fitting groove parts 401, respectively. The inner surface of the fitting groove part 401 has a protruded curved surface which protrudes inside. The pair of lead wires 71 are pressed and inserted into the pair of the fitting groove parts 401, respectively, in the direction which is perpendicular to the longitudinal direction of each of the pair of lead wires 71.

The pair of lead wires 71 have the same structure of the coil-side lead wire 51 and the connector-side lead wire 52 used in the ignition coil 1 according to the first exemplary embodiment, excepting the structure extended from the electronic component 7. In addition, the connector terminal 40 used in the ignition coil 1 according to the fourth exemplary embodiment has the same structure of the connector terminal 4 used in the ignition coil 1 for an internal combustion engine of the first exemplary embodiment. Further, the pair of fitting groove parts 401 used in the ignition coil 1 according to the fourth exemplary embodiment have the same structure of the connector-side fitting groove part 41 used in the ignition coil 1 for an internal combustion engine of the first exemplary embodiment.

The pair of fitting groove parts 401 have the same depth direction. In the fourth exemplary embodiment, the depth direction of the pair of fitting groove parts 401 is the bottom direction which is equal to the depth direction of each of the connector-side fitting groove part 41 and the coil-side fitting groove part 31. However, it is acceptable for them to a direction which is different from the bottom direction.

In the ignition coil 1 for an internal combustion engine according to the fourth exemplary embodiment, the electronic component 7 is a capacitor which is electrically connected to a node between the positive electrode and the negative electrode of the battery 101 (see FIG. 7) through the connector terminal 40. The electronic component 7 receives a noise current generated when the ignition coil 1 is turned ON.

Other parts and components of the ignition coil 1 for an internal combustion engine of the fourth exemplary embodiment are the same as those of the ignition coil 1 for an internal combustion engine of the first exemplary embodiment. The same reference numbers and characters between the fourth exemplary embodiment and the first exemplary embodiment indicate the same parts and components in the ignition coil 1. The explanation of the same parts and components is omitted here for brevity.

The structure of the ignition coil 1 according to the fourth exemplary embodiment allows the electronic component 7 to be assembled with the ignition coil 1. The ignition coil 1 for an internal combustion engine of the fourth exemplary embodiment has the same action and effects of the ignition coil 1 for an internal combustion engine of the first exemplary embodiment. It is acceptable to use other electronic components such as a Zener diode instead of using the capacitor.

Fifth Exemplary Embodiment

Figure 12:
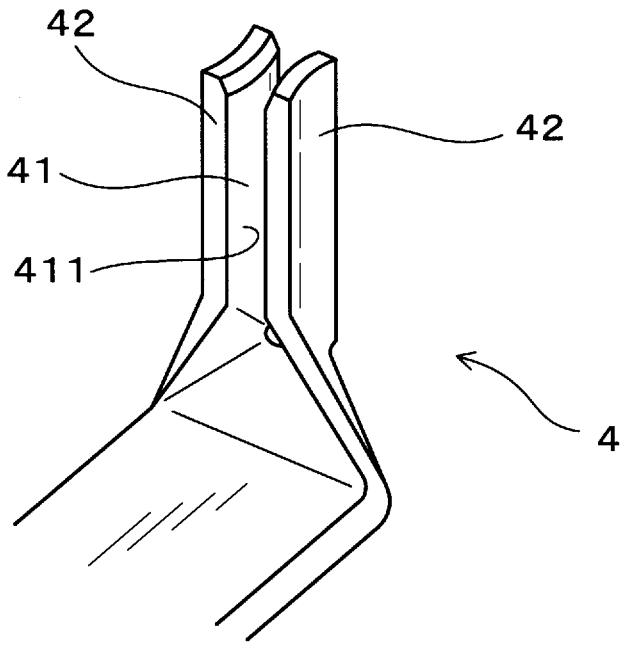
FIG. 12 is a perspective view showing the connector terminal in the ignition coil for an internal combustion engine according to a fifth exemplary embodiment.
Figure 13:
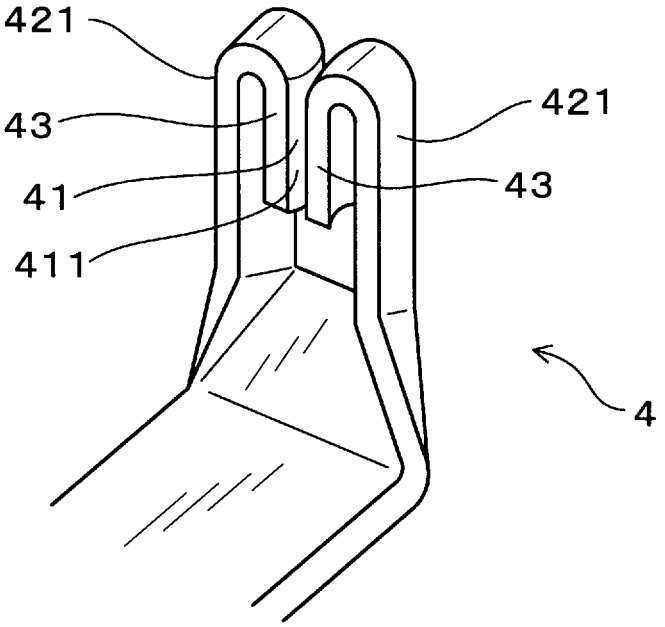
FIG. 13 is a perspective view showing the connector terminal having another structure in the ignition coil for an internal combustion engine according to the fifth exemplary embodiment.
Figure 14:
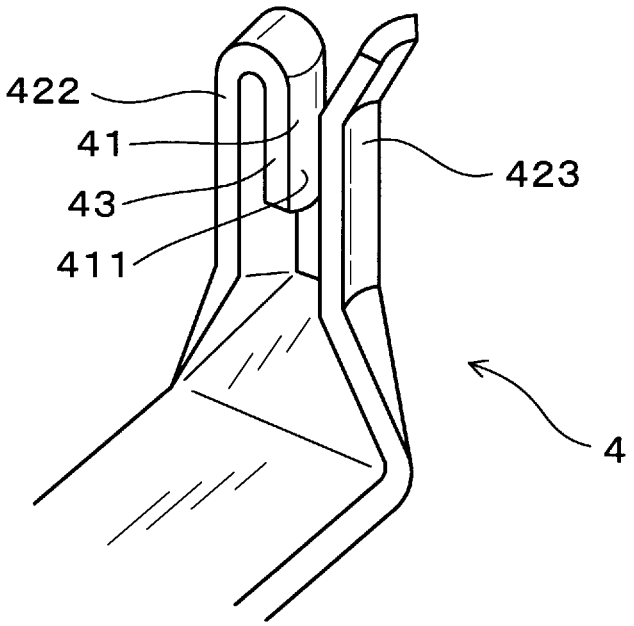
FIG. 14 is a perspective view showing the connector terminal having another structure in the ignition coil for an internal combustion engine according to the fifth exemplary embodiment.

A description will be given of the ignition coil 1 for an internal combustion engine according to a fifth exemplary embodiment with reference to FIG. 12 to FIG. 14. FIG. 12 to FIG. 14 shows the connector-side fitting groove part 41 having different shapes which are different from the shape of the connector-side fitting groove part 41 used in the ignition coil 1 according to the first exemplary embodiment. In the ignition coil 1 according to the fifth exemplary embodiment, the connector terminal 4 has the connector-side fitting groove part 41 produced by bending a plate.

For example, the connector terminal 4 shown in FIG. 12 has a pair of branched vertical parts 42 which extend upward. The connector-side fitting groove part 41 is formed between the pair of branch vertical parts 42. Each of the branched vertical parts 42 has an internal edge surface 411 formed internally to have a protruded curved surface so that the internal edge surfaces 411 of the pair of branched vertical parts 42 are facing with each other. The pair of branched vertical parts 42 are curved toward the connector-side fitting groove part 41 when viewed from a cross section which is perpendicular to the vertical direction Z.

The connector terminal 4 shown in FIG. 13 has a pair of branched vertical parts 421 which extend upward. A pair of turned parts 43 are produced by bending the upper part of each of the branched vertical parts 421 inside. The connector-side fitting groove part 41 is formed between the pair of turned parts 43.

Each of the turned parts 43 has the internal edge surface 411 formed internally to have a protruded curved surface so that the internal edge surfaces 411 of the pair of turned parts 43 are facing with each other. The pair of turned parts 43 are curved toward the connector-side fitting groove part 41 when viewed from a cross section which is perpendicular to the vertical direction Z.

The connector terminal 4 shown in FIG. 14 has a pair of branched vertical parts 422, 423. In the pair of branched vertical parts 422 and 423, only the branched vertical part 422 has the turned part 43. The front part of the branched vertical part 423 is curved upward. The turned part 43 is facing with the branched vertical part 423. That is, the internal edge surface 411 of each of the turned part 43 and the branched vertical part 423 is curved inside to form a protruded curved surface. The internal edge surfaces 411 of the turned part 43 and the branched vertical part 423 form the connector-side fitting groove part 41.

The turned parts 43 and the branched vertical part 423 are curved toward the connector-side fitting groove part 41 when viewed from a cross section which is perpendicular to the vertical direction Z.

Other parts and components of the ignition coil 1 for an internal combustion engine of the fifth exemplary embodiment are the same as those of the ignition coil 1 for an internal combustion engine of the first exemplary embodiment. The same reference numbers and characters between the fifth exemplary embodiment and the first exemplary embodiment indicate the same parts and components in the ignition coil 1. The explanation of the same parts and components is omitted here for brevity. The ignition coil 1 for an internal combustion engine of the fifth exemplary embodiment has the same action and effects of the ignition coil 1 for an internal combustion engine of the first exemplary embodiment. It is also acceptable for the connector terminal 4 to have various shapes other than the shapes shown in the first and fifth exemplary embodiments.

Sixth Exemplary Embodiment

Figure 15:
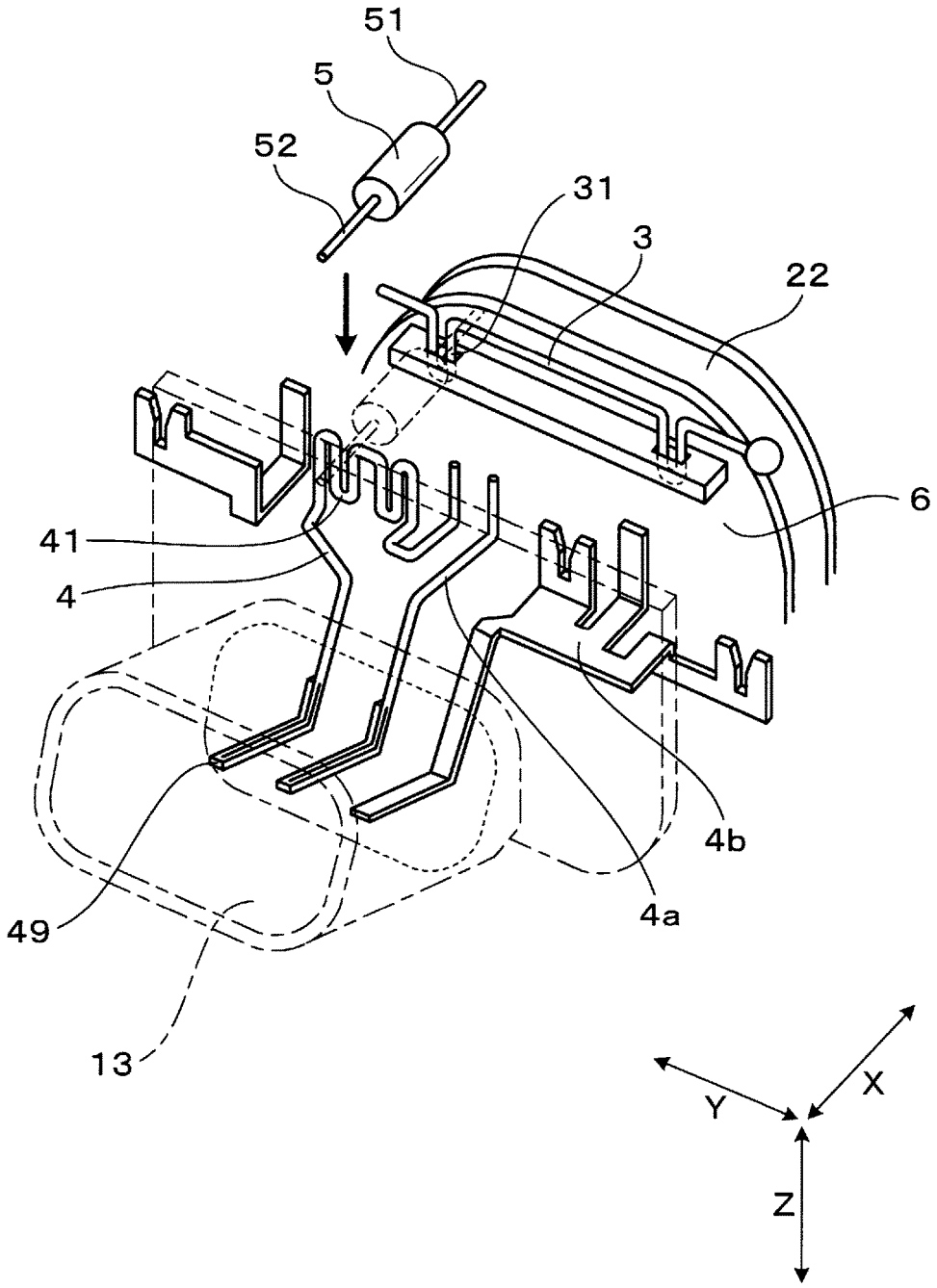
FIG. 15 is a perspective view showing a part of the ignition coil for an internal combustion engine according to a sixth exemplary embodiment.

A description will be given of the ignition coil 1 for an internal combustion engine according to a sixth exemplary embodiment with reference to FIG. 15. As shown in FIG. 15, in the ignition coil 1 for an internal combustion engine according to the sixth exemplary embodiment, the connector terminal 4 is made of wire member. That is, the connector terminal 4 is made of the same wire member which also forms the coil terminal 3. The connector terminal 4 is connected to the connector-side lead wire 52 of the connector part 5. The connector-side fitting groove part 41 is formed by bending the wire member. The outside end part 49 of the connector terminal 4 is produced by bending and press-molding a part of the wire member.

The outer connector 13 is equipped with connector terminals 4*a* and 4*b* in addition to the connector terminal 4. The connector terminal 4 is connected to the connector part 5. The connector terminals 4*a* and 4*b* are independently arranged to the outer connector 13. Similar to the connector terminal 4, the connector terminal 4*a* is produced by bending the wire member. The connector terminal 4*b* is made of a plate member, like the connector terminal 4 shown in the explanation of the first exemplary embodiment.

Other parts and components of the ignition coil 1 for an internal combustion engine of the sixth exemplary embodiment are the same as those of the ignition coil 1 for an internal combustion engine of the first exemplary embodiment. The same reference numbers and characters between the sixth exemplary embodiment and the first exemplary embodiment indicate the same parts and components in the ignition coil 1. The explanation of the same parts and components is omitted here for brevity.

In the structure of the ignition coil 1 for an internal combustion engine according to the sixth exemplary embodiment, because the wire member forming the connector-side lead wire 52 is connected to the wire member forming the connector terminal 4, this makes it possible to effectively prevent the connector-side lead wire 52 and the connector terminal 4 from being cut with each other. Further, the connector-side lead wire 52 and the connector terminal 4 are made of the wire member, this structure makes it possible to further increase material yield.

The ignition coil 1 for an internal combustion engine of the sixth exemplary embodiment has the same action and effects of the ignition coil 1 for an internal combustion engine of the first exemplary embodiment.

Seventh Exemplary Embodiment

Figure 16:
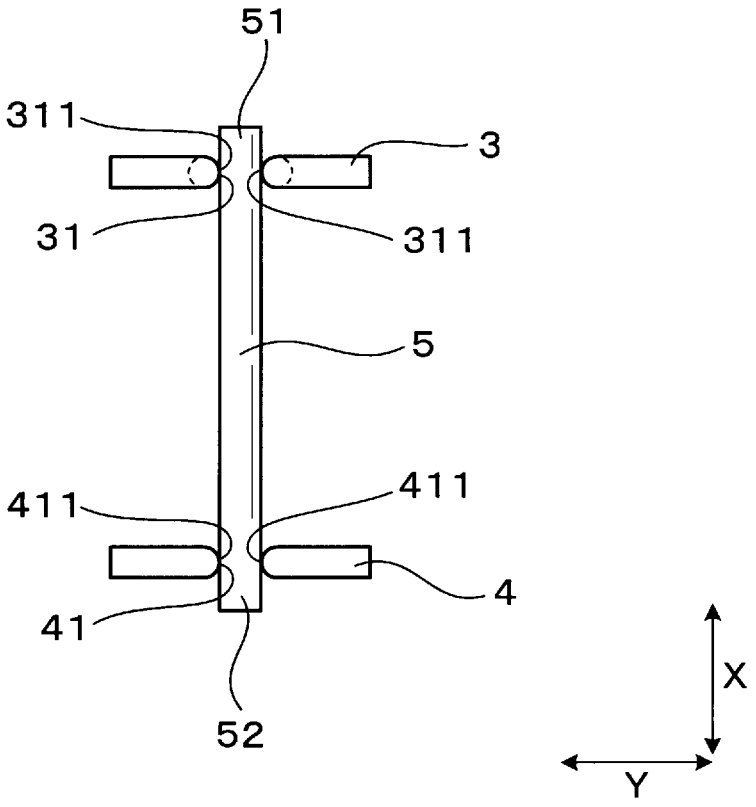
FIG. 16 is a plan view showing a connector part connected to the coil terminal and the connector terminal in the ignition coil for an internal combustion engine according to a seventh exemplary embodiment.

A description will be given of the ignition coil 1 for an internal combustion engine according to a seventh exemplary embodiment with reference to FIG. 16. As shown in FIG. 16, in the ignition coil 1 for an internal combustion engine according to the seventh exemplary embodiment, the connector part 5 is simply made of a conductive wire.

The conductive wire forming the connector part 5 is a rod shape having a circular cross section which is perpendicular to the longitudinal direction of the connector part 5. One end part of the connector part 5 corresponds to the coil-side lead wire 51, and the other end part of the connector part 5 corresponds to the connector-side lead wire 52. The connector part 5 has the same shape along the longitudinal direction thereof.

Other parts and components of the ignition coil 1 for an internal combustion engine of the seventh exemplary embodiment are the same as those of the ignition coil 1 for an internal combustion engine of the first exemplary embodiment. The same reference numbers and characters between the seventh exemplary embodiment and the first exemplary embodiment indicate the same parts and components in the ignition coil 1. The explanation of the same parts and components is omitted here for brevity.

The ignition coil 1 for an internal combustion engine of the seventh exemplary embodiment has the same action and effects of the ignition coil 1 for an internal combustion engine of the first exemplary embodiment. It is also acceptable for the connector terminal 4 to have various shapes other than the shapes shown in the first and fifth exemplary embodiments.

It is possible for the conductive wiring as the connector part 5 to have a shape or structure which is different from the shape of the conductive wire used in the ignition core 1 according to the seventh exemplary embodiment. For example, it is possible to have another structure in which a central part, in the longitudinal direction, of the conductive wire is covered with an insulation part. This structure makes it possible to easily handle the conductive wire (i.e. the connector part 5), and to easily assemble the connector part 5 with the ignition coil 1.

The concept of the present invention is not limited by each of the first to seventh exemplary embodiments, and it will be appreciated by those skilled in the art that various modifications and alternatives to those details could be developed in light of the overall teachings of the disclosure. Still further, it is acceptable to combine the subject matters recited in the exemplary embodiments.

REFERENCE SIGNS LIST

1 Ignition coil for internal combustion engine, 21 Primary coil, 22 Secondary coil, 3 Coil terminal, 31 Coil-side fitting groove part, 311 Internal edge surface (of coil-side fitting groove part), 4 Connector terminal, 41 Connector-side fitting groove part, 411 Internal side surface (of connector-side fitting groove part), 5 Connector part, 51 Coil-side lead wire, and 52 Connector-side lead wire.

The invention claimed is:

1. An ignition coil for an internal combustion engine comprising:

a primary coil and a secondary coil magnetically connected with each other;

a coil terminal connected to a low voltage side of the secondary coil;

a connector terminal electrically connected to an external device; and a connector part connected to and suspended by both the coil terminal and the connector terminal;

wherein the connector part comprises:

a coil-side lead wire made of wire member connected to the coil terminal; and a connector-side lead wire made of wire member connected to the connector terminal, the coil terminal comprises a coil-side fitting groove part into which the coil-side lead wire is pressed and inserted, and an internal edge surface of the coil-side fitting groove part is formed internally to have a protruded curved surface, the connector terminal comprises a connector-side fitting groove part into which the connector-side lead wire is pressed and inserted, and an internal edge surface of the connector-side fitting groove part is formed internally to have a protruded curved surface, the coil-side lead wire is pressed and inserted into the coil-side fitting groove part in a direction which is perpendicular to a longitudinal direction of the coil-side lead wire, and the connector-side lead wire is pressed and inserted into the connector-side fitting groove part in a direction which is perpendicular to a longitudinal direction of the connector-side lead wire, wherein the coil terminal is made of wire member, and supported by a terminal holder formed in a bobbin in which the secondary coil is wounded, and the terminal holder comprises a deformation limitation part which limits expansion of the coil-side fitting groove part.

2. The ignition coil for an internal combustion engine according to claim 1, wherein a depth direction of the coil-side fitting groove part is equal to a depth direction of the connector-side fitting groove part.

3. The ignition coil for an internal combustion engine according to claim 1, wherein the connector terminal is made of a plate member.

4. The ignition coil for an internal combustion engine according to claim 1, wherein the connector terminal is made of a wire member.

5. The ignition coil for an internal combustion engine according to claim 1, further comprising:

a plurality of the connector terminals electrically insulated from each other;

an electronic component supported by two connector terminals in the plurality of connector terminals, and the electronic component comprising a pair of lead wires made of a wire member connected to the two connector terminals, wherein the two connector terminals connected to the pair of lead wires comprises a fitting groove part into which the pair of lead wires are pressed and inserted, an internal edge surface of the fitting groove part has a protruded curved surface which protrudes toward inside, and the pair of lead wires are pressed and inserted into the fitting groove part in a direction which is perpendicular to the longitudinal direction of the pair of lead wires.

6. The ignition coil for an internal combustion engine according to claim 5, wherein the depth direction of each of the pair of fitting groove parts has a same direction from each other.

7. An ignition coil for an internal combustion engine comprising:

a primary coil and a secondary coil magnetically connected with each other;

a coil terminal connected to a low voltage side of the secondary coil;

a connector terminal electrically connected to an external device; and a connector part connected to and suspended by both the coil terminal and the connector terminal;

wherein the connector part comprises:

a coil-side lead wire made of wire member connected to the coil terminal; and a connector-side lead wire made of wire member connected to the connector terminal, the coil terminal comprises a coil-side fitting groove part into which the coil-side lead wire is pressed and inserted, and an internal edge surface of the coil-side fitting groove part is formed internally to have a protruded curved surface, the connector terminal comprises a connector-side fitting groove part into which the connector-side lead wire is pressed and inserted, and an internal edge surface of the connector-side fitting groove part is formed internally to have a protruded curved surface, the coil-side lead wire is pressed and inserted into the coil-side fitting groove part in a direction which is perpendicular to a longitudinal direction of the coil-side lead wire, and the connector-side lead wire is pressed and inserted into the connector-side fitting groove part in a direction which is perpendicular to a longitudinal direction of the connector-side lead wire, wherein a depth direction of the coil-side fitting groove part is equal to a depth direction of the connector-side fitting groove part.

8. The ignition coil for an internal combustion engine according to claim 7, wherein the connector terminal is made of a plate member.

9. The ignition coil for an internal combustion engine according to claim 7, wherein the connector terminal is made of a wire member.

10. The ignition coil for an internal combustion engine according to claim 7, wherein the coil terminal is made of wire member.

11. The ignition coil for an internal combustion engine according to claim 10, wherein the coil terminal is supported by a terminal holder formed in a bobbin in which the secondary coil is wounded.

12. An ignition coil for an internal combustion engine comprising:

a primary coil and a secondary coil magnetically connected with each other;

a coil terminal connected to a low voltage side of the secondary coil;

a connector terminal made of wire member and electrically connected to an external device; and a connector part connected to and suspended by both the coil terminal and the connector terminal;

wherein the connector part comprises:

a coil-side lead wire made of wire member connected to the coil terminal; and a connector-side lead wire made of wire member connected to the connector terminal, the coil terminal comprises a coil-side fitting groove part into which the coil-side lead wire is pressed and inserted, and an internal edge surface of the coil-side fitting groove part is formed internally to have a protruded curved surface, the connector terminal comprises a connector-side fitting groove part into which the connector-side lead wire is pressed and inserted, and an internal edge surface of the connector-side fitting groove part is formed internally to have a protruded curved surface, the coil-side lead wire is pressed and inserted into the coil-side fitting groove part in a direction which is perpendicular to a longitudinal direction of the coil-side lead wire, and the connector-side lead wire is pressed and inserted into the connector-side fitting groove part in a direction which is perpendicular to a longitudinal direction of the connector-side lead wire.

* * * * *